US011759915B2

(12) United States Patent
Rentz

(10) Patent No.: US 11,759,915 B2
(45) Date of Patent: Sep. 19, 2023

(54) PNEUMATIC LATCH CLAMP

(71) Applicant: Delaware Capital Formation, Inc., Wilmington, DE (US)

(72) Inventor: Matthew Rentz, Shelby Township, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 17/492,620

(22) Filed: Oct. 3, 2021

(65) Prior Publication Data

US 2023/0104256 A1 Apr. 6, 2023

(51) Int. Cl.
*B25B 5/12* (2006.01)
*B25B 5/06* (2006.01)
*B25B 5/16* (2006.01)

(52) U.S. Cl.
CPC ..... *B25B 5/122* (2013.01); *B25B 5/064* (2013.01); *B25B 5/16* (2013.01)

(58) Field of Classification Search
CPC ..... B25B 5/122; B25B 5/064; B25B 5/16; B25B 5/061
USPC ..... 269/32, 201, 208
See application file for complete search history.

(56) References Cited

U.S. PATENT DOCUMENTS 3,027,155 A 3/1962 Paterson
4,083,272 A * 4/1978 Miller ..... B23Q 17/2495 451/163
5,460,358 A 10/1995 Sendoykas
5,823,519 A 10/1998 Tunkers
5,829,112 A * 11/1998 Blatt ..... B25B 5/16 29/525
6,105,947 A * 8/2000 Dykstra ..... B25B 5/087 269/157
6,814,349 B2 11/2004 Migliori
6,845,975 B2 1/2005 Tunkers
6,908,077 B2 6/2005 Sawdon
7,686,286 B2 * 3/2010 Colby ..... B25B 5/087 269/27
8,132,800 B2 3/2012 Tamai
8,454,003 B2 6/2013 Kaiser
8,967,604 B2 3/2015 Fleischer
(Continued)

FOREIGN PATENT DOCUMENTS

CH 682379 A5 9/1993
CN 208500737 U * 2/2019 ..... C03B 9/193
(Continued)

OTHER PUBLICATIONS

English translation of CN 208500737U (Year: 2019).*
Extended European Seach Report dated Feb. 7, 2023 in corresponding European Application No. 2219800535 (8 pages).

*Primary Examiner* — Tyrone V Hall, Jr.
*Assistant Examiner* — Sukwoo James Chang
(74) *Attorney, Agent, or Firm* — Harness, Dickey & Pierce, P.L.C.

(57) ABSTRACT

A power clamp includes a body. A piston assembly is coupled with the body. The piston assembly includes an actuation mechanism and a movable piston rod. A linkage is housed in the body. The linkage is movably coupled with the piston rod. A plunger is movably coupled with the linkage. A clamp hook is coupled with the plunger for clamping a workpiece. The linkage moves the clamp hook between a release and clamping position.

13 Claims, 4 Drawing Sheets

(56) References Cited

U.S. PATENT DOCUMENTS

| | | | | |
|---|---|---|---|---|
| 9,261,174 | B2 | 2/2016 | Li et al. | |
| 9,440,318 | B1 * | 9/2016 | Tibbets | E05B 19/20 |
| 9,789,589 | B2 | 10/2017 | Migliori | |
| 10,174,820 | B2 | 1/2019 | Bottacini | |
| 10,184,551 | B2 | 1/2019 | Bottacini | |
| 10,328,551 | B2 | 6/2019 | Kaiser | |
| 10,625,382 | B2 | 4/2020 | Dellach | |
| 2004/0021260 | A1 * | 2/2004 | Migliori | B25B 5/061 269/32 |
| 2004/0084823 | A1 * | 5/2004 | Rentz | B25B 5/122 269/32 |
| 2007/0045362 | A1 | 3/2007 | Colby | |

FOREIGN PATENT DOCUMENTS

| | | | |
|---|---|---|---|
| EP | 0163219 | A1 | 12/1985 |
| EP | 1152110 | A2 | 11/2001 |

* cited by examiner

PNEUMATIC LATCH CLAMP

FIELD

The present disclosure relates to a clamp and more particularly, to a power clamp utilized in harsh environments.

BACKGROUND

When utilizing various types of clamps, in harsh environments, it is difficult to utilize a manual clamp. While the manual clamp may be utilized in these environment, they are susceptible to damage from the environment. Thus, it is possible, due to harshness of the environment, that the manual clamps may be compromised.

Thus, it is desirable to have a powered clamp that can be utilized in harsh environments. The clamp provides a clean appearance and retains the necessary lubricants within the clamp. It is desirable to have a clamp that provides these features.

Accordingly, the present disclosure provides a power clamp that overcomes the deficiencies of the prior art. The present clamp provides utilization in harsh environments while keeping the necessary lubricants within the clamp. Further, it provides a clean appearance. The present disclosure provides a clamp with a composition material that does not require lubrication. Thus, a drive operation does not attract dust or debris. The present disclosure provides operation in various orientations while providing a solid feel while the linkage is stopped or play is kept internally within the body. The present application also provides that the clamp can be positioned or operated manually when required. Also, the clamp can have a left or right side mounting.

SUMMARY

According to the present disclosure, a power clamp comprises a body and a piston assembly coupled with the body. The piston assembly includes an actuation mechanism and a movable piston rod. A linkage is housed within the body. The linkage is movably coupled with the piston rod. A plunger is movably coupled with the linkage. A clamp hook is coupled with the plunger to clamp a workpiece. The linkage moves the clamp hook between a release and clamped position. The linkage includes a first, second and third links. The first link is pivotally connected to the body and pivotally connected to the second link. The second link pivotally connects with the plunger and the first link. A pin is coupled with the piston rod pivotally connecting the third link. The third link is coupled with the first and second links. A second pin is coupled with the second link. The second pin moves in a track, in the body, to provide motion to the clamp. The second pin is coupled with the plunger. A pivotable trunnion supports the plunger. The trunnion includes a composite bearing supporting the plunger. The body is manufactured from a plastic material and includes a pair of metal side cover plates. Additionally, a pair of mounting plates are positioned over the cover plates to enable the power clamp to be secured to a surface. A post projects from the first link outside of the body. A clamp handle is coupled with the post to manually rotate the clamp between a clamping and release position. A release handle is rotatably coupled with the body and includes a fourth link associated with the third link to move the clamp out of the clamped position. A spring is associated with the release handle to return the release handle to its original starting position. The body encloses the linkage and piston connection. Sensors are present to sense the operation of the piston and power clamp assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
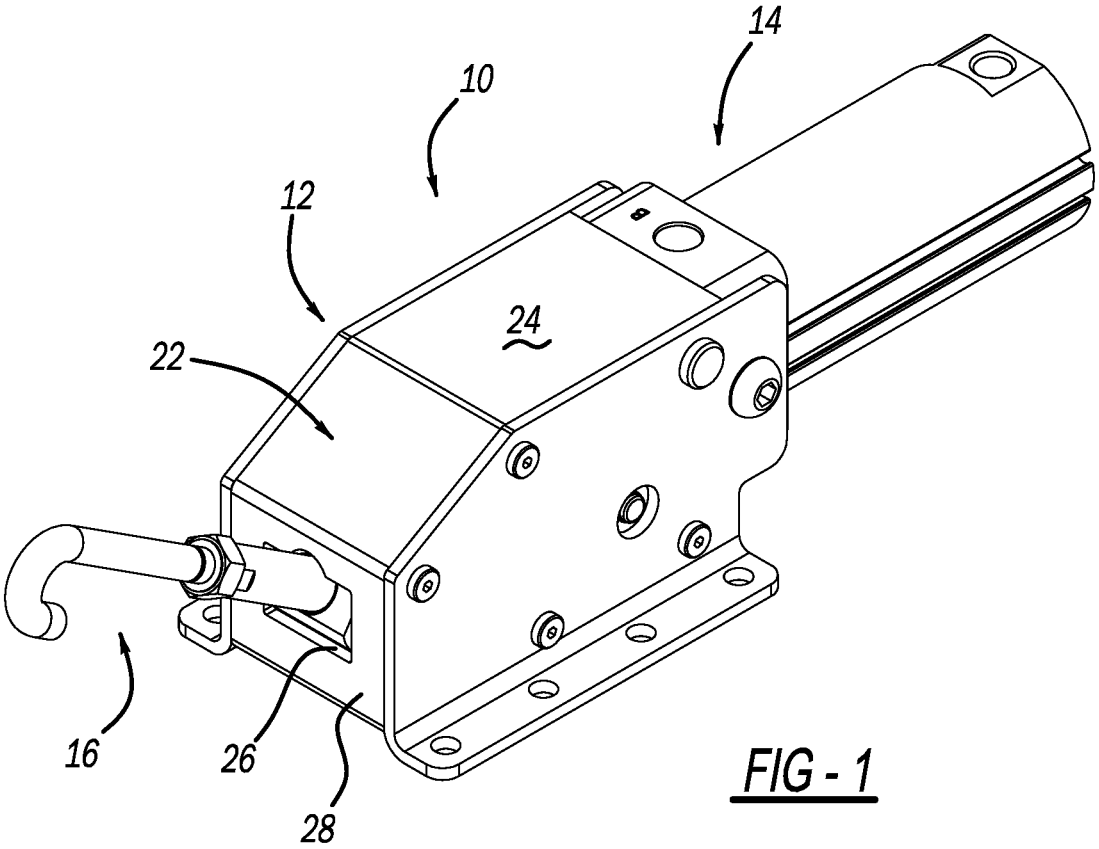
FIG. 1 is a perspective view of a power clamp.

Example embodiments will now be described more fully with reference to the accompanying drawings.

A power clamp is illustrated and designated with the reference numeral 10. The power clamp 10 includes a body 12 and piston assembly 14. A clamp hook 16 is actuated by the piston assembly 14 via a linkage 20.

The body 12 includes a molded plastic housing portion 22 having opened sides with an overall rectangular configuration illustrated with a pentagonal wall 24. The wall 24 includes an opening 26 in a front face 28 to receive the clamp hook 16. An opening 30 in a rear face 32 receives the piston assembly 14. Also, the housing 22 includes a plurality of bosses 34 and bores 36 that receive fasteners to retain various elements on the housing 22. The housing 22 protects and encloses the linkage 20.

Figure 2:
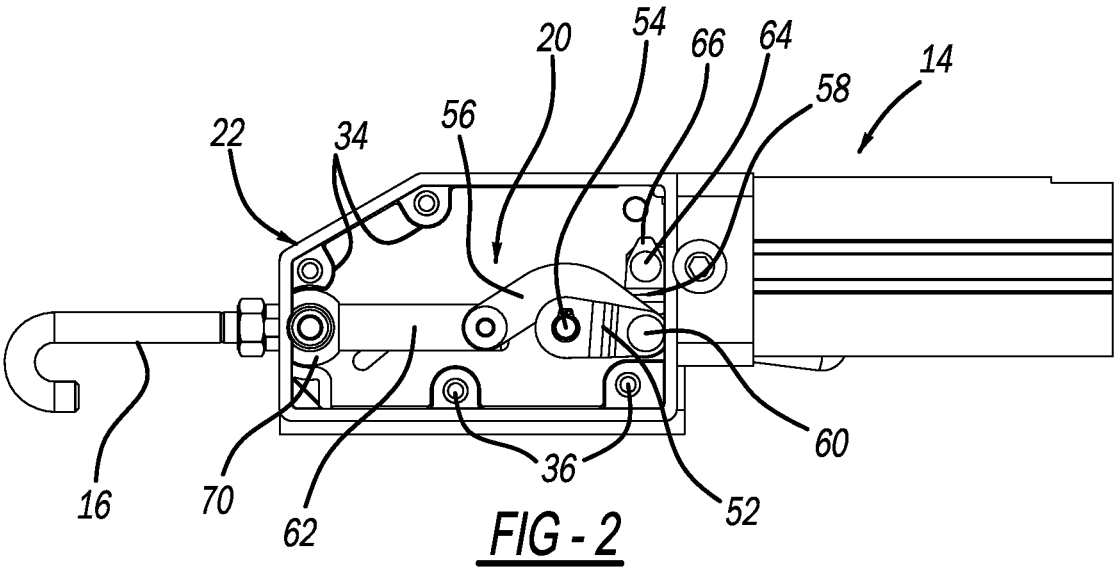
FIG. 2 is a side elevation view with the mounting plates removed.

Fasteners may be inserted into the bosses 34 and bores 36 to secure outer cover plates 38 with the housing 22. The cover plates 38 are inlayed within a boundary recess of the housing 22 as illustrated in FIG. 2. The cover plates 38 are thus flushed with the sides of the housing 22. At least one of the cover plates 38 includes a slot 40 to receive the linkage 20 to assist in guiding the linkage 20 which, in turn, controls the movement of the clamp hook 16. As illustrated, the slot 40 has a L-shape with an obtuse angle between the legs of the L. The cover plates 38 are stamped metal and fit into the recesses of the housing 22. The slot 40 or track is also stamped into the cover plate 38 to provide motion for the clamp hook 16. The slot 40 provides pivot points for the plunger, linkage 20 and clamp hook 16 as will be explained herein. Additionally, the cover plates 38 provide additional stability for the plastic housing 22.

Mounting plates 42 have a configuration similar to plates 38. However, the mounting plates 42 include a ledge 43 to secure the clamp 10 to a surface. The ledge 43 generally is perpendicular to the body 44 of the plate 40 to provide an L-shaped plate. The mounting plates 40 cover the cover plates 38 as well as the sides of the housing 22 as illustrated in FIG. 1. Fasteners 46 passes through the mounting plates 42 to retain the piston assembly 14 with the body 12.

Figure 3:
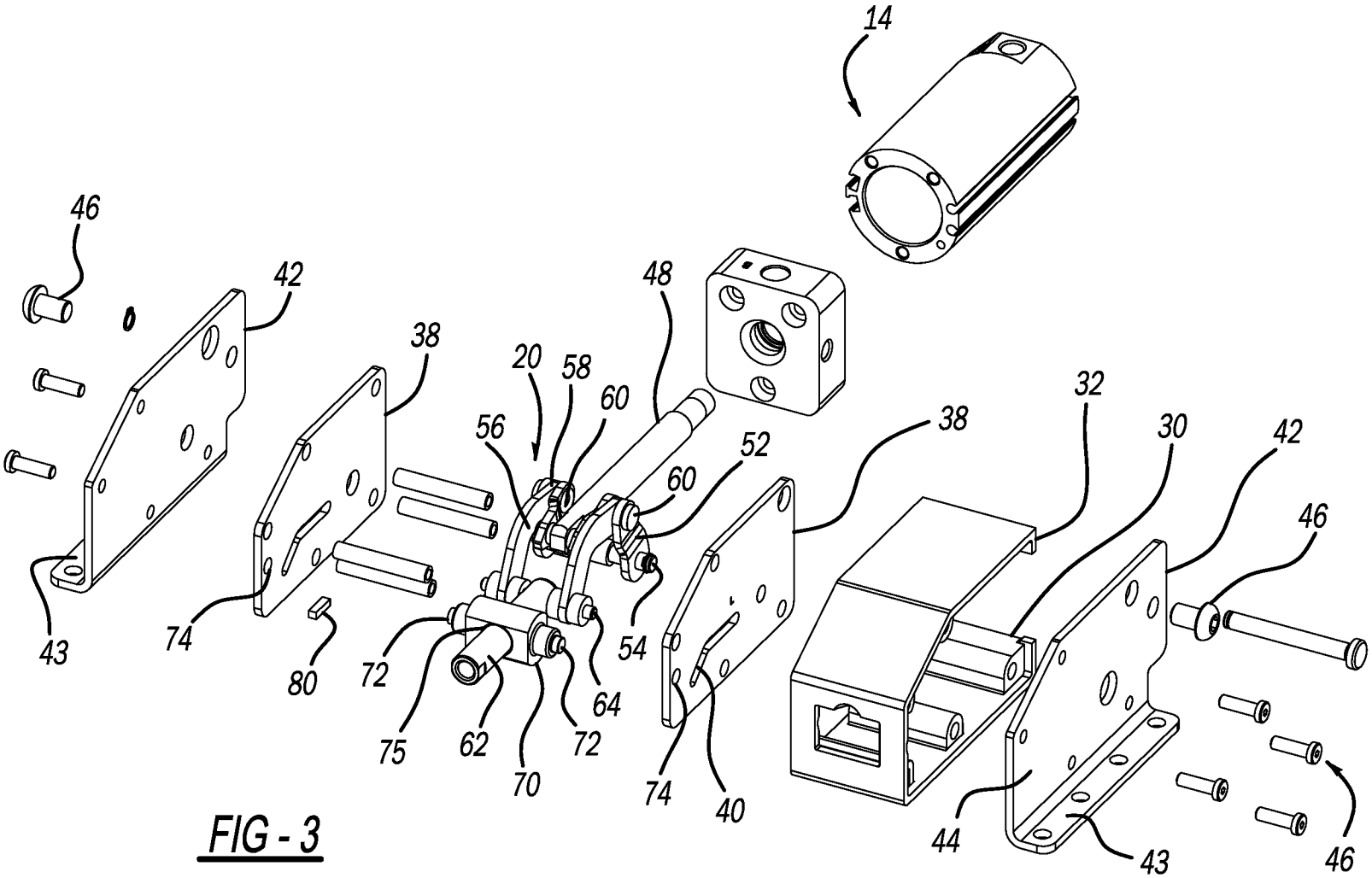
FIG. 3 is an exploded perspective view of the clamp.

Turning to FIGS. 2 and 3, the linkage 20 is illustrated. The piston assembly 14 includes a piston rod 48. A plurality of links illustrated with three links are secured with the piston rod 48, via a pin passing through the piston rod 48. A first link 52 is pivotally secured via a pin 54 with the body 12. A second end of the link 52 is pivotally secured to the second link 56 and third link 58 via a pin 60. The three links 52, 56 and 58 are pivotal with respect to the pin 60. The second link 56 has an overall L-shape with its second end pinned with the plunger 62. The pin 64 enables the second link 56 to pivot with respect to the plunger 62. The third link 58 is pivotally secured with the piston rod 48, via pin 54. The third link 58 rotatably pivots with respect to the pin 64. The third link 58 includes a projection portion 66 that extends above the piston rod 48 as illustrated in FIG. 2.

The plunger 62 is coupled with the clamp hook 16. The plunger 62 is passed through a trunnion 70. The trunnion 70 is secured rotatably secured between the cover plates 38, via pins 72, projecting from the trunnion 70 into apertures 74 in the cover plates 38. The trunnion 70 includes a composite bearing 74 pressed into the trunnion 70. The composite bearing 75 supports the plunger 62 as it moves through the trunnion 70. The composite bearing 75 provides the lubricant for the plunger 62. The trunnion 70 pivots in the cover plates 38 and maintains the proper plunger 62 position.

In operation, the piston rod 48 extends away from the piston block. As this occurs, the clamp hook 16 moves upward into a release position as seen in FIG. 1. The clamp hook 16 is adjustable with plunger 62 and moves from the release position to a clamping position. As the piston rod 48 is extended, the links pivot with respect to one another. The first link 52 is rotated as is the second link 56 by the third link 58. The second link 56, via pin 64, follows in the slot 40 so that the plunger 62 is moved out of the body 12 and into the release position as illustrated in FIG. 1. The pin 64 travels to the bottom of the slot away from the piston assembly 14.

In order to lock the clamp hook 16, the piston rod 48 is retracted into the piston body. As this occurs, the pin 64 travels in the slot 40 towards the piston assembly 14. As the pin 64 travels up the incline portion of the slot 40, the clamp hook 16 is rotated from the released position, illustrated in FIG. 1, to a position wherein the plunger 62 is substantially parallel with the piston rod 48. This occurs at the intersection of the two legs of the slot 40. As retraction continues, the plunger 62 is drawn into the body 12 as the clamp hook 16 is drawn toward the body 12 into a clamped position. At the end of the stroke, the pin 64 in the slot 40 is close to the piston assembly 14, as illustrated in FIG. 2. Here, the pivot pin 60 central axis is positioned below the axis of a line moving through the pin 54, 64 as illustrated in FIG. 2. Thus, an overcenter toggle lock position is created. Thus, if a loss of pressure occurs in the piston assembly 14, whether or intentional or not, the clamp 10 will hold the part as intended. Thus, as the piston rod 48 is extended, the linkage 20 moves from the overcenter position to a release position as explained above.

A sensor 80 is positioned in the body 12. The sensor 80 senses the stroke of the linkage 20 to provide information to a controller on the clamped and release positions of the power claim 10.

Figure 4:
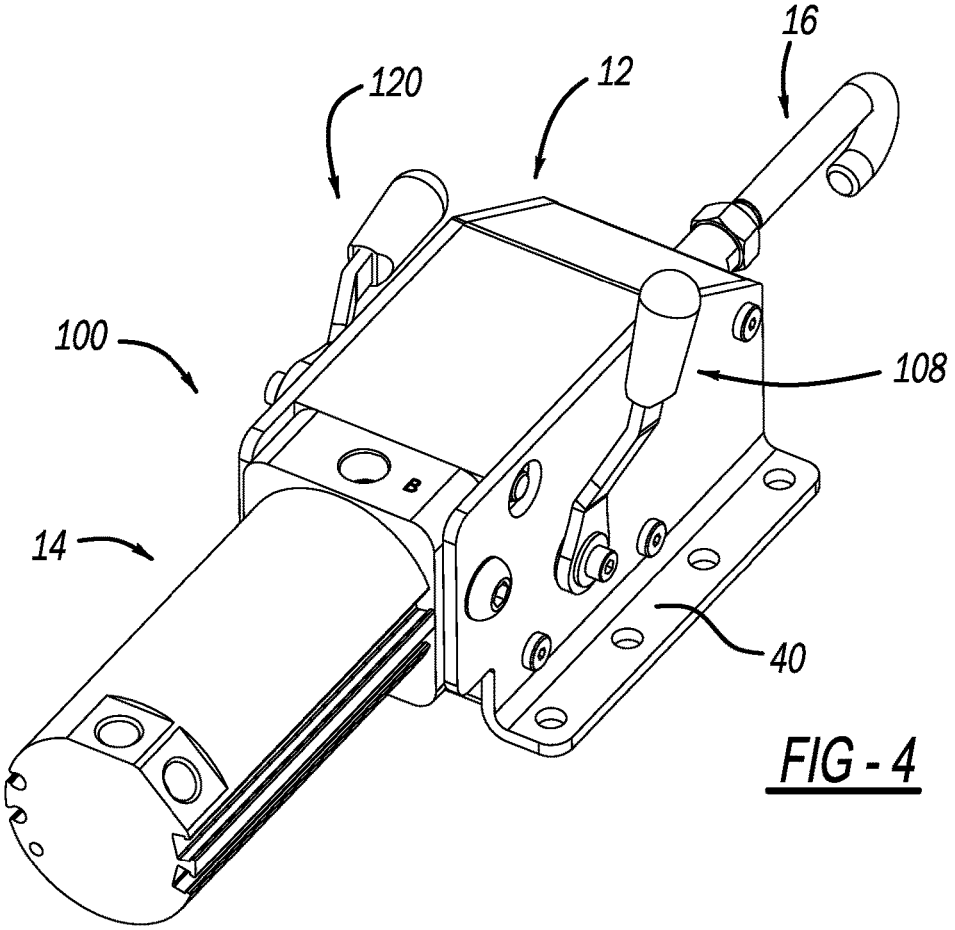
FIG. 4 is a perspective view of a clamp with manual actuation.
Figure 5:
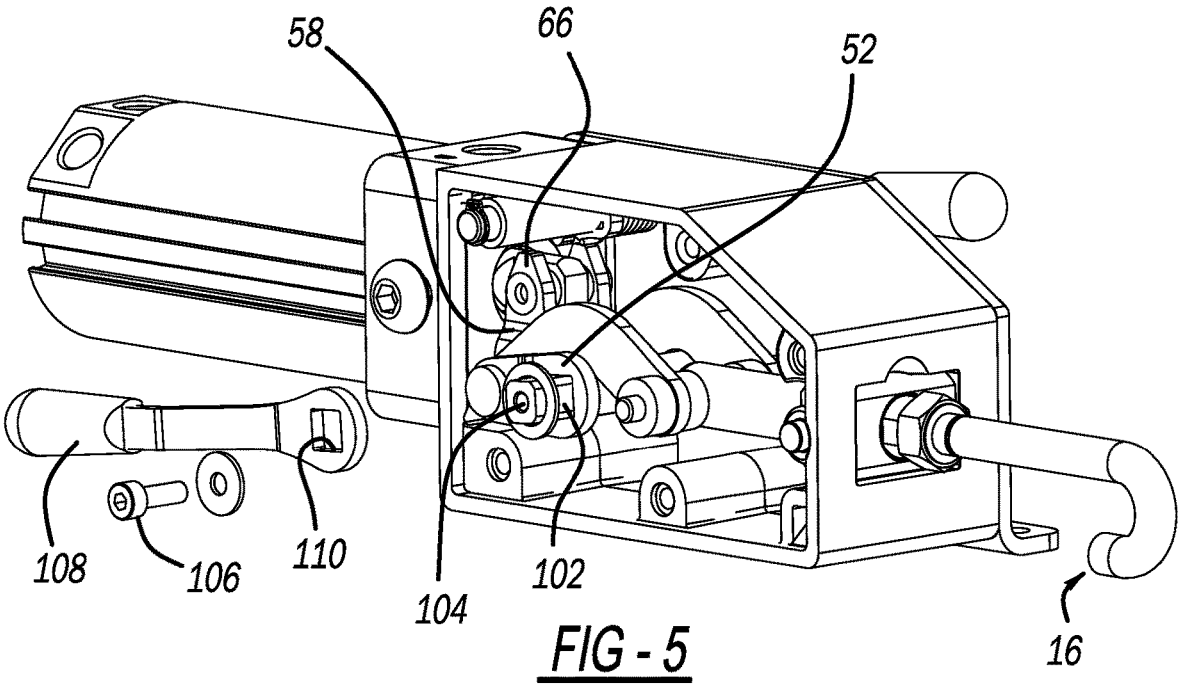
FIG. 5 is a partial exploded view of the clamp of FIG. 4.
Figure 6:
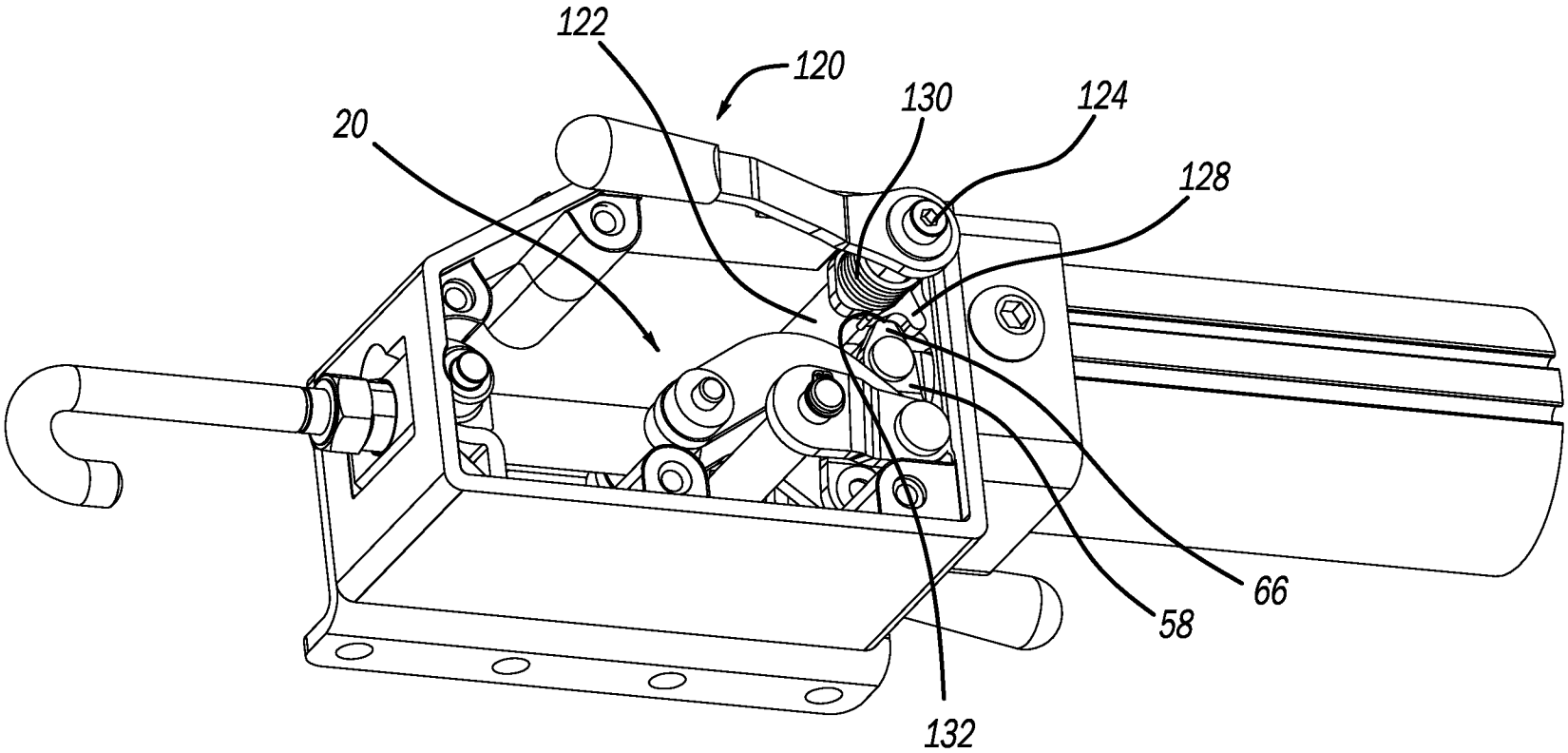
FIG. 6 is a perspective view with the cover plates removed of FIG. 4.

Turning to FIGS. 4-6, a manually operated version of the clamp 100 is illustrated. Here, a square or rectangular driveshaft 102 is on the first link 52. The rectangular driveshaft 102 includes a bore 104 to receive a fastener 106 that holds the clamp handle 108 onto the rectangular shaft 102. The handle 108 includes a rectangular aperture 110 that fits over the rectangular shaft 102. The shaft 102 extends through the plates 38 so that the handle 108 can be maintained on the shaft 102.

The handle 108 is rotated from a release position to a clamped position as illustrated in FIGS. 4 and 5. As the clamp 100 is rotated from the release position illustrated in FIG. 4 into the clamped position as illustrated in FIG. 5, the linkage 20 moves through the path as described above. Thus, as the handle 108 is rotated, the clamp hook 16 moves from the retracted position into the clamping position.

Turning to FIG. 6, a release handle 120 is illustrated. The release handle 120 manually releases the linkage 20 from the overcenter toggle lock position. The handle 120 is secured to the body 12, via a shaft 122, that extends through the body 12. A fastener 124 is received into a shaft 122 to secure the handle 120. The shaft 122 includes a rectangular portion like that described above. Likewise, handle 120 includes a rectangular aperture to receive the shaft 122. The shaft 122 includes a fourth link 126. The fourth link 126 includes an arm 128. Additionally, a spring 130 provides a return forced. The spring 130 surrounds the shaft 122. One end of the spring is secured to the shaft 122. The other end is received in a detent 132 on the fourth link 126. Thus, the spring 130 returns the handle 120 to its original position after release of the linkage.

The arm 128 contacts the projecting portion 66 of the first link 52. The handle 120 is rotated which, in turn, rotates the shaft 122. As the shaft 122 is rotated, the fourth link 126 is rotated with the arm 128 contacting the projecting portion 66. The contact with the projecting portion 66 continues until the arm 128 rotates the first link pushing the linkage 20 out of the overcenter position. Once the first link 58 is released from the overcenter toggle lock position, the spring 130 returns the handle 124 to its original position. Thus, the handle 108 can be actuated to move the clamp hook 16 out of the clamped position. Also, the piston assembly 14 could be utilized to move the linkage 20 out from the overcenter position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power clamp comprising:

a body;

a piston assembly coupled with the body, the piston assembly including an actuation mechanism and a movable piston rod;

a linkage housed in the body, the linkage movably coupled with the piston rod, a first pin is coupled with the linkage, the first pin moving in a nonlinear track in a pair of fixed side cover plate of the body;

a plunger movably coupled with the linkage, the linkage includes a first link pivotally connected to the body and pivotally connected to a second link, the second link has an overall L-shaped and is pivotally connected with the plunger, via the first pin, and a third link pivotally coupled with the piston rod, a second pin coupled with the piston rod pivotally connects with the third link, the third link pivotally couples with the piston rod and pivotally coupled with the first and second links; and a clamp hook coupled with the plunger for clamping a workpiece, the linkage moving the clamp hook between a release and clamping position.

2. The power clamp of claim 1, wherein the pin is coupled with the plunger.

3. The power clamp of claim 1, further comprising a rotatable trunnion for supporting the plunger.

4. The power clamp of claim 3, wherein the trunnion includes a composite bearing supporting the plunger.

5. The power clamp of claim 1, wherein the body is plastic and the pair of side cover plates are metal.

6. The power clamp of claim 1, further comprising a shaft projecting from the first link outside of the body.

7. The power clamp of claim 6, wherein a clamp handle couples with the shaft for manually rotating the clamp between its clamping and release positions.

8. The power clamp of claim 1, wherein a release handle is rotatably coupled with the body, a fourth link is associated with the third link for moving the clamp hook from the clamped position.

9. The power clamp of claim 8, wherein a spring is associated with the release handle for returning the release handle to an original position.

10. The power clamp of claim 5, further comprising a second pair of metal plates for mounting the power clamp to a surface.

11. The power clamp of claim 1, wherein the body encloses the linkage and piston connection.

12. The power clamp of claim 1, wherein a sensor senses operation of the power clamp.

13. A power clamp comprising:

a body;

a piston assembly coupled with the body, the piston assembly including an actuation mechanism and a movable piston rod;

a linkage housed in the body, the linkage movably coupled with the piston rod, a first pin is coupled with the linkage, the first pin moving in a nonlinear track in a pair of fixed side cover plate of the body;

a plunger movably coupled with the linkage, the linkage includes a first link pivotally connected to the body and pivotally connected to a second link, the second link has an overall L-shaped and is pivotally connected with the plunger, via the first pin, and a third link pivotally coupled with the piston rod, a second pin coupled with the piston rod pivotally connects with the third link, the third link pivotally couples with the piston rod and pivotally coupled with the first and second links; and a rotatable trunnion for supporting the plunger; and a clamp hook coupled with the plunger for clamping a workpiece, the linkage moving the clamp hook between a release and clamping position.

* * * * *